US007152859B2

(12) United States Patent
Flynn et al.

(10) Patent No.: US 7,152,859 B2
(45) Date of Patent: Dec. 26, 2006

(54) SHEET SEPARATOR

(75) Inventors: Neil Flynn, Arlesey (GB); Geoff Purbrick, Sandy (GB)

(73) Assignee: Xerox Corporation, Stamford, CT (US)

( * ) Notice: Subject to any disclaimer, the term of this patent is extended or adjusted under 35 U.S.C. 154(b) by 345 days.

(21) Appl. No.: 10/868,148

(22) Filed: Jun. 15, 2004

(65) Prior Publication Data

US 2005/0275156 A1 Dec. 15, 2005

(51) Int. Cl.
*B65H 3/52* (2006.01)

(52) U.S. Cl. ..... 271/121; 271/167

(58) Field of Classification Search ..... 271/119, 271/121, 167, 127
See application file for complete search history.

(56) References Cited

U.S. PATENT DOCUMENTS

| | | | | |
|---|---|---|---|---|
| 4,815,724 | A * | 3/1989 | Sumida et al. | 271/121 |
| 5,377,969 | A | 1/1995 | Steinhilber | 271/21 |
| 5,527,026 | A | 6/1996 | Padget et al. | 271/21 |
| 5,895,040 | A | 4/1999 | Oleksa et al. | 271/124 |
| 5,899,450 | A | 5/1999 | Gettelfinger et al. | 271/121 |
| 5,971,390 | A | 10/1999 | Caspar et al. | 271/121 |
| 5,996,989 | A | 12/1999 | Cahill et al. | 271/121 |
| 6,065,886 | A | 5/2000 | Embry et al. | 400/629 |
| 6,139,007 | A | 10/2000 | Cahill et al. | 271/121 |
| 6,254,080 | B1 | 7/2001 | Bass | 271/10.11 |
| 6,279,897 | B1 | 8/2001 | Richards | 271/121 |
| 6,296,244 | B1 | 10/2001 | Hanks et al. | 271/118 |
| 6,318,715 | B1 | 11/2001 | Froechte et al. | 271/117 |
| 6,375,183 | B1 | 4/2002 | Inoue et al. | 271/10.11 |
| 6,536,757 | B1 * | 3/2003 | Chang | 271/16 |
| 6,644,502 | B1 | 11/2003 | Pearce et al. | 221/127 |
| 6,716,254 | B1 * | 4/2004 | Takeuchi | 271/167 |
| 2003/0116907 | A1 | 6/2003 | Pearce et al. | 271/145 |

* cited by examiner

*Primary Examiner*—Patrick Mackey
*Assistant Examiner*—Kaitlin Joerger
(74) *Attorney, Agent, or Firm*—David J. Arthur

(57) ABSTRACT

A sheet separator for a printer includes a plurality of inclined separator strips, with a feed mechanism for urging a sheet from a stack toward the separator strips. The separator strips are oriented at an obtuse angle relative to the sheets of the stack, and at least one of the inclined separator strips is a retard separator strip. The retard separator strip includes a first separator surface closer to the stack, and a second separator surface farther from the stack. The second separator surface has a higher coefficient of friction than the first separator surface. The plane of at least a portion of the first separator surface is above the plane of the second separator surface of the same retard separator strip. The proximal portion of the first separator surface nearer to the stack of sheets forms a larger obtuse angle with respect to the sheets than does a distal portion of that first separator surface.

4 Claims, 5 Drawing Sheets

SHEET SEPARATOR

BACKGROUND AND SUMMARY

The present invention relates to a sheet separator for separating adjacent sheets of recording media being fed from a stack of sheets, so that only one sheet is fed to a process station, such as a print engine of a printer or copier.

One mechanism for feeding cut sheet recording media from a stack of sheets frictionally engages the topmost sheet to slide the topmost sheet toward a process station, such as a print engine of a printer of copier. On occasion, the next adjacent sheet in the stack may be propelled along with the topmost sheet, causing a "multi-feed" situation. One contributor to such multi-feed situations is that when the paper manufacturer cuts the paper to form the stack of cut sheets, the edges of adjacent sheets may partially fuse together, a situation sometimes referred to as edge welding.

In a media tray, a sheet feed mechanism capable of feeding heavy recording media has an increased probability of improperly feeding multiple sheets of a lighter weight recording media. Some apparatus incorporate sensors to detect multi-feed situations and take corrective action.

The present invention encompasses a simplified mechanism to separate multiple sheets of recording media fed from a media tray, which mechanism does not depend on sensors, and still permits a wide range of media weights to be used.

In accordance with an aspect of the present invention, an apparatus for separating a sheet of recording media from a stack of sheets includes a support for supporting a stack of sheets of recording media, and a plurality of inclined separator strips. The separator strips are substantially parallel to one another, and the surface of each inclined separator strip is oriented at an obtuse angle relative to the sheets of the stack of sheets. At least one of the inclined separator strips is a retard separator strip that includes a first separator surface and a second separator surface. The first separator surface is closer to the stack of sheets then is the second separator surface, and the second separator surface has a higher coefficient of friction than does the first separator surface.

In accordance with another aspect of the present invention, an apparatus for separating a sheet of recording media from a stack of sheets includes a support for supporting a stack of sheets of recording media and a plurality of inclined separator strips in which the inclined separator strips are substantially parallel to one another, and the surface of each inclined separator strip is oriented at an obtuse angle relative to the sheets of the stack of sheets. At least one of the inclined separator strips is a retard separator strip that includes a first separator surface and a second separator surface, and in which the first separator surface is closer to the stack of sheets than is the second separator surface. The plane of at least a portion of the first separator surface is above the plane of the second separator surface.

In accordance with yet another aspect of the present invention, a sheet separator element for use in a sheet feed path of a printing device includes a first separator surface and a second separator surface, in which the second separator surface has a higher coefficient friction than does the first separator surface, and wherein the plane of at least a portion of the first separator surface is above the plane of the second separator surface.

In accordance with yet another aspect of the present invention, a sheet separator element for use in a sheet feed path of a printing device includes a first separator surface comprising a distal segment and a proximal segment, and a second separator surface. A proximal segment of the first separator surface forms an obtuse angle with the distal segment of the first separator surface, and the proximal segment of the first separator surface is between the second separator surface and the distal segment of the first separator surface. The plane of the proximal segment of the first separator surface at an edge nearest the second separator surface is above the plane of the second separator surface. The plane of the proximal segment of the first separator surface and the plane of the second separator surface are oriented at an oblique angle with respect to one another. The distal and proximal segments of the separator surface have a first coefficient of friction, and the second separator surface has a second coefficient friction, higher than the first coefficient friction.

In accordance with yet another aspect of the present invention, a method of separating a sheet of recording media from a stack of sheets includes urging two or more topmost sheets of a stack of sheets toward a plurality of inclined separator strips, wherein at least of one of the inclined separator strips is a retard separator strip. The method further includes causing the topmost sheets to move upward along a first separator surface of the retard separator strip until a leading edge of the topmost sheets moves past an edge of the first separator surface. After the topmost sheet has moved along the first separator surface of the retard separator strip, causing a leading edge of one of the topmost sheets to engage in a second separator surface of the retard separator strip, wherein the second separator surface has a higher coefficient of friction than does the first separator surface. The method further includes continuing to urge the topmost sheet along the retard separator strip so that the first topmost sheet moves while the second topmost sheet is restrained by the second separator surface of the retard separator strip.

DETAILED DESCRIPTION

Figure 1:
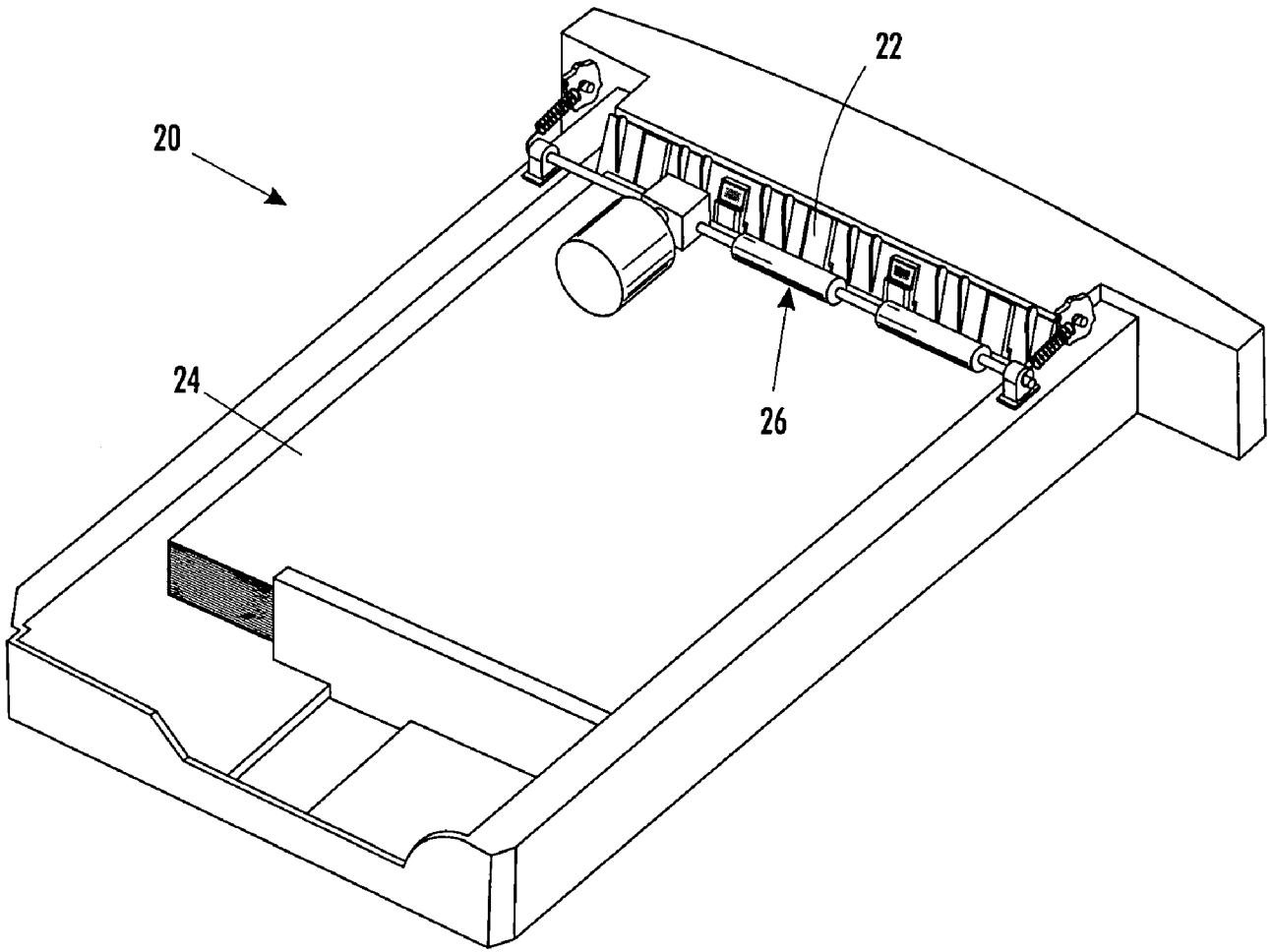
FIG. 1 is a perspective view of a media tray having an embodiment of a sheet separator according to an aspect of the present invention.

FIG. 1 is a perspective view of a media tray 20 for containing a stack of sheets of recording media 24, and having a sheet separator 22 at one side of the media tray. The media tray can be used in a printer, such as a xerographic or inkjet printer. The illustrated media tray may be particularly useful as the high capacity media tray capable of holding several hundred or more sheets of recording media, such as printer paper. The media tray may also contain transparencies, envelopes, card stock, or other print media.

Figure 2:
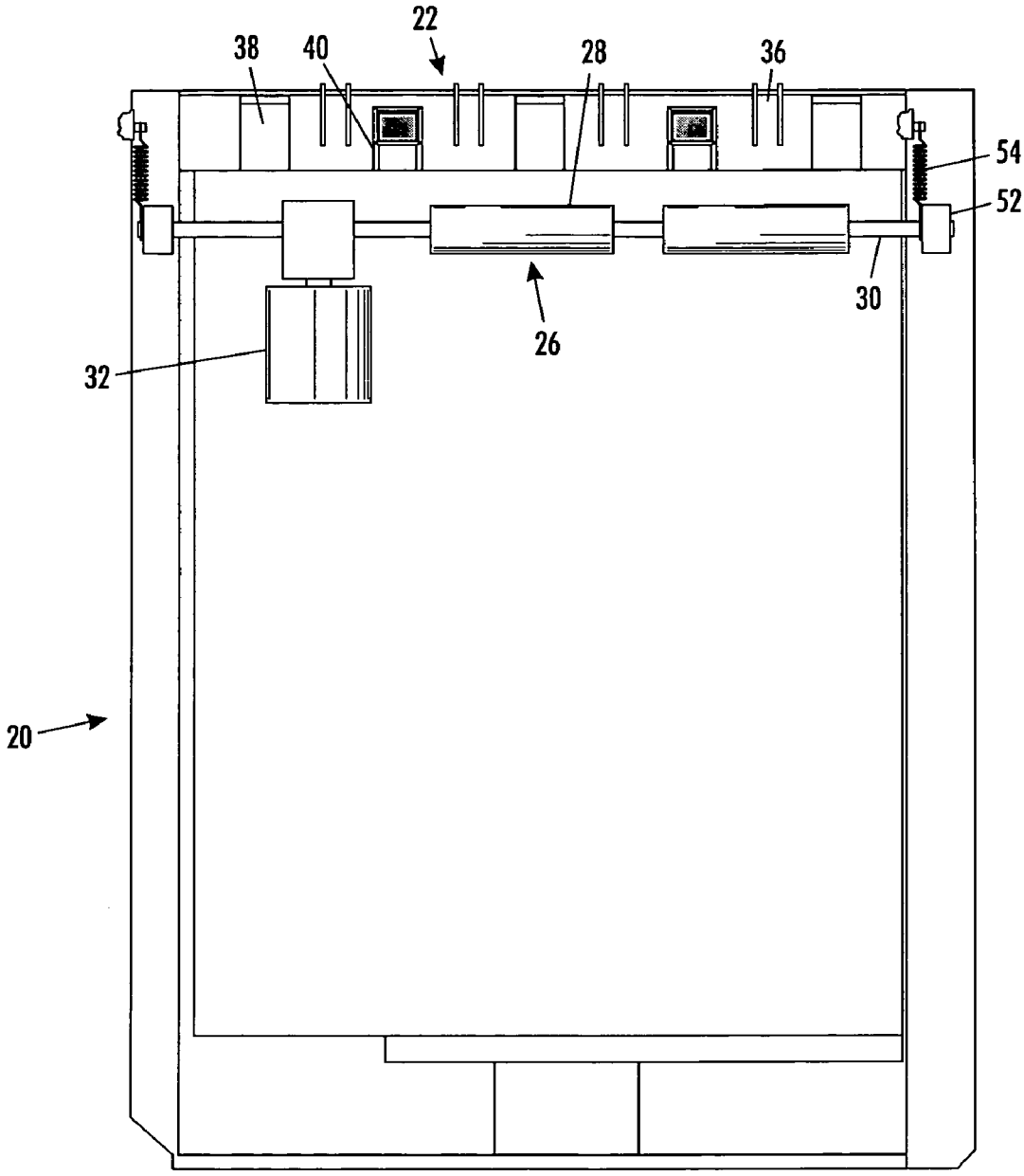
FIG. 2 is a top view of the media tray and sheet separator of FIG. 1.
Figure 3:
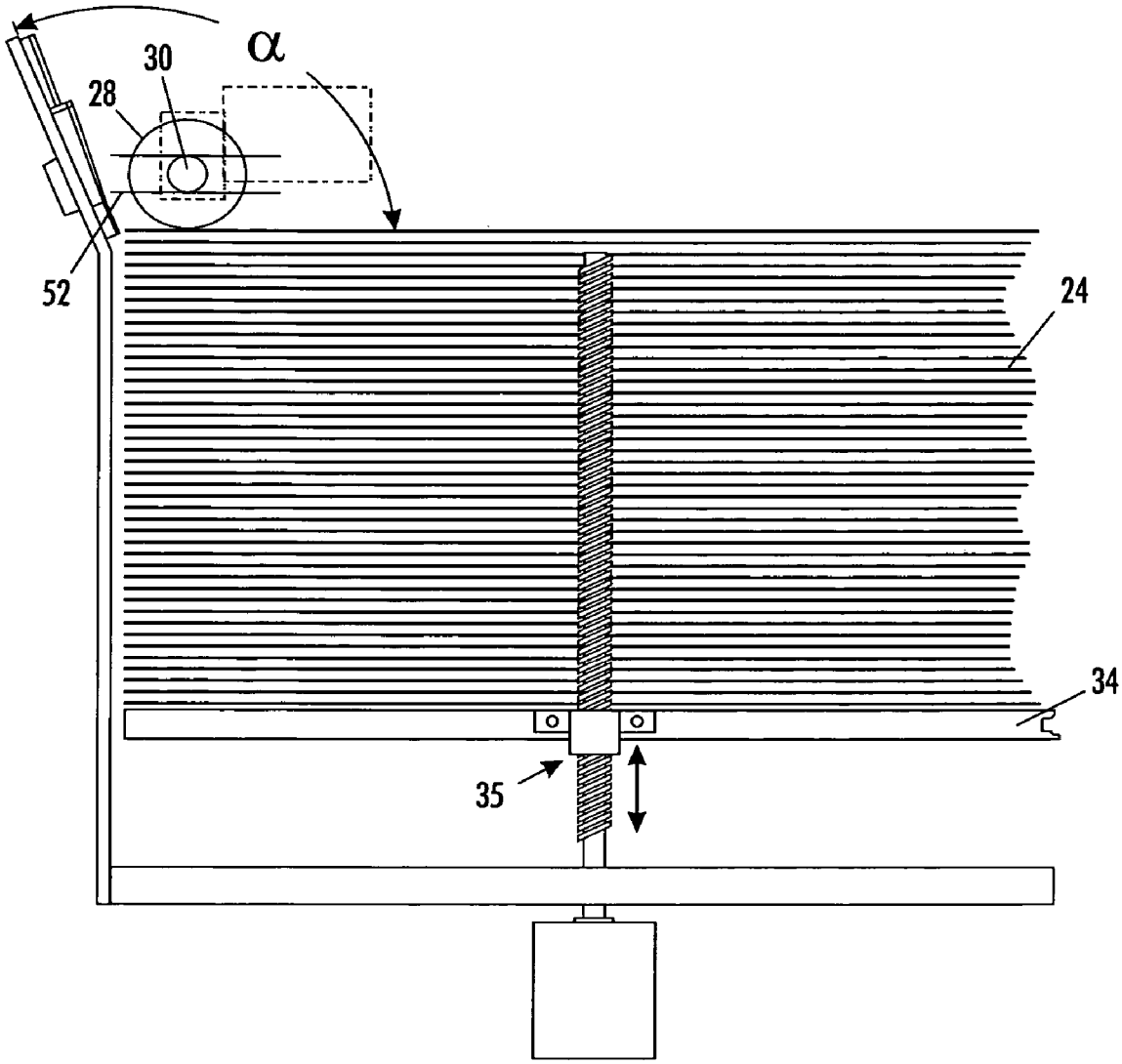
FIG. 3 is a side cross-sectional view of the media tray and sheet separator, taking along line 3—3 of FIG. 2.

As seen in FIGS. 1–3, a sheet feeder 26 is adapted to urge a sheet of recording media from inside the media tray toward the sheet separator 22. The sheet feeder engages a sheet of the recording media in the stack to urge the sheet toward the sheet separator at or near the edge of the media tray. In the particular implementation shown, the sheet feeder frictionally engages the topmost sheet of the stack, and urges that topmost sheet toward the separator apparatus. In further particularity, the illustrated embodiment of the sheet feeder includes cylindrical grippers 28 that are rotated about an axle 30 by a feed motor 32. The surface of the grippers 28 may include longitudinal ribs. The axle 30 of the grippers is substantially perpendicular to the direction of travel for the media sheet. The particular embodiment of sheet feeder shown has a fixed vertical position relative to the media tray. Those skilled in the art will be familiar with other types of sheet feeders appropriate for this type of media tray.

As seen in FIG. 3, the media tray has a support surface 34 for supporting a stack of sheets of recording media. In the particular media tray illustrated, the support surface is fitted atop an elevator 35 that can raise the support surface 34 within the tray to lift the stack of recording sheets as recording sheets are removed from the stack. The elevator is adapted so that the topmost sheet of recording media of the stack is at a substantially constant level within the tray. A simplified illustration of an exemplary gear-driven elevator is shown. Persons skilled in the art will be familiar with this and other types of elevator mechanisms for providing such a liftable support surface, and therefore the particularities thereof are not shown or described here.

The sheet separator 22 separates the topmost sheet of recording media from other sheets if the sheet feeder 26 should feed multiple sheets from the stack. From the sheet separator, a sheet of media enters a media path in the machine to which the media tray is attached. In an example, the media sheet enters a media path leading to the print engine that will apply an image to the media sheet. The sheet separator helps to ensure that multiple sheets are not simultaneously fed to the print engine.

The sheet separator includes a separator surface 36 oriented at an obtuse angle relative to the sheets of the stack, and particularly to the topmost sheet of the stack. The separator surface may be oriented at an angle of approximately 113° relative to the surface of the topmost sheet of recording media (23° beyond perpendicular). In the particular illustrated implementation, the sheet separator includes a plurality of inclined separator strips 38, 40 that are substantially parallel to one another. At least one of separator strips is a retard separator strip 40. In the particular implementation illustrated, the sheet separator apparatus includes five separator strips, two of which are retard separator strips 40. A regular separator strip 38 is on either side of each of the retard separator strips. FIG. 2 shows the angle of the sheet separator exaggerated (not to scale) for ease of viewing and understanding.

Each of the regular separator strips 38 is formed of a relatively low friction plastic material, and has a substantially planar separator face surface that is oriented at an obtuse angle $\alpha$ relative to the surface of the topmost sheet of recording media in the stack. In an implementation, the surface of the regular separator strip 38 is substantially parallel to the separator surface 36, and thus the angle between the surface of the topmost sheet of recording media in the stack and the surface of the regular separator strip 38 is approximately 113° (approximately 23° greater than perpendicular).

Figure 4:
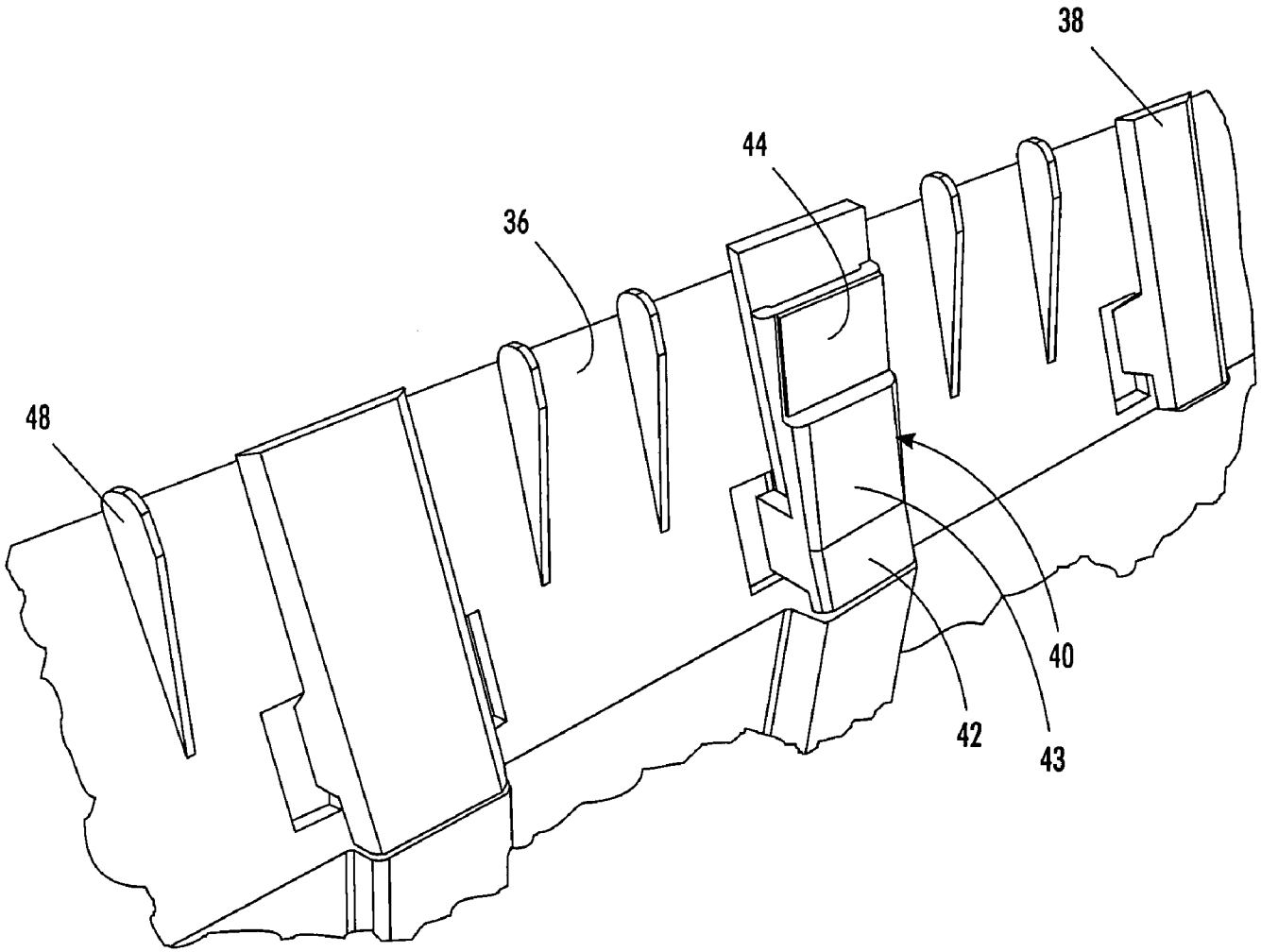
FIG. 4 is an enlarged view of a portion of an embodiment of the sheet separator.

The retard separator strips 40 of the sheet separator are positioned approximately symmetrically about the center line on the sheet separator, and have a conventional separator strip between them. Referring to FIG. 4, the retard separator strip 40 includes a first separator surface 42, 43 and a second separator surface 44. The first separator surface 42, 43 is closer to the stack of sheets than is the second separator surface 44. The first separator surface 42, 43 has a lower coefficient of friction than does the second separator surface 44. For example, the first separator surface may be formed of a plastic material similar to the material forming the regular separator strip 38, with a similar smooth, low friction surface. The second separator surface 44 may include a surface of a rubberized or softer plastic material providing a higher coefficient of friction than that of the surface of the first separator surface 42, 43.

Figure 5:
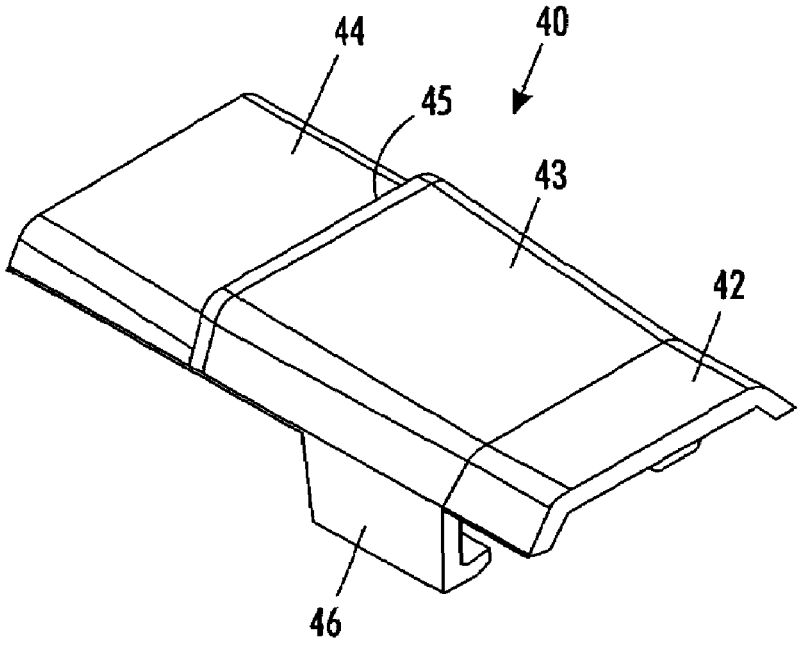
FIG. 5 is a perspective view of one embodiment of the sheet separator element.
Figure 6:
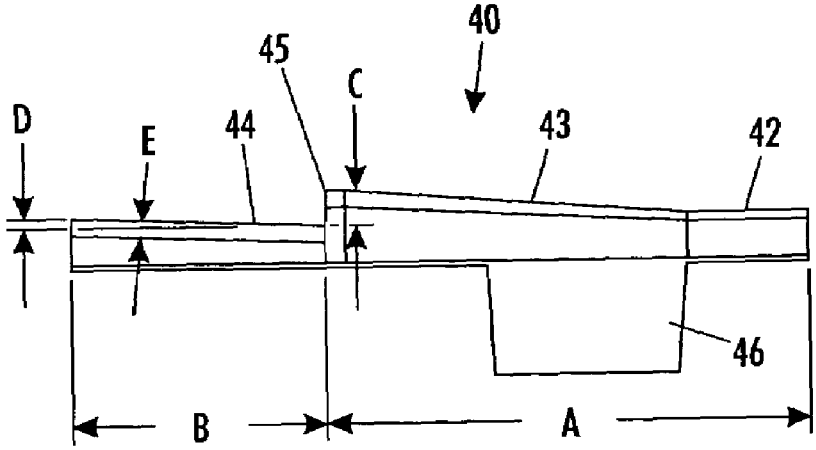
FIG. 6 is a side view of the sheet separator element of FIG. 5.

Referring with further particularity to FIGS. 4–6, the plane of at least a portion of the first separator surface is above the plane of the second separator surface. In further particularity, the first separator surface includes a proximal portion 42 that is nearer to the stack of recording media sheets when the retard separator strip is installed in the sheet separator (and farther from the second separator surface). The plane of the proximal portion 42 of the first separator surface may be substantially parallel to the plane of the separator surface, so that the angle between the topmost sheet of the recording media and the proximal portion 42 of the first separator surface is approximately 113°.

In a particular embodiment, the first separator surface also includes a distal portion 43 that is nearer to the second separator surface 44, and farther from the stack of recording media sheets when the retard separator strip is installed in the sheet separator. The first separator surface is sloped between the proximal portion 42 and the distal portion 43 so that the first separator surface is more steeply angled (has a smaller oblique angle) with respect to the sheets of the stack of recording media away from the stack than it is adjacent the stack. The plane of the first separator surface forms a small obtuse angle relative to the media sheets at its distal end than at its proximal end. In an alternative, the variation in angle between the proximal end and the distal end may be continuous, rather than an abrupt change in angle.

As the sheet feeder urges the topmost sheet of the stack toward the separator apparatus, the leading edge of the sheet engages the separator strips, including both the regular separator strips 38 and the retard separator strips 40. When encountering the retard separator strip 40, the leading edge of the sheet initially encounters the proximal portion 42 of the first separator surface. The angle of incidence between the leading edge of the topmost sheet and the proximal portion of the first separator surface is obtuse. As the sheet feeder continues to urge the topmost sheet along, the leading edge of the sheet slides along the first separator surface from the proximal end portion toward the distal portion.

If edge welding or another phenomenon has caused two or more sheets to be urged simultaneously toward the sheet separator, the increasing angle of incidence as the leading edge of the paper moves along the first separator surface from the proximal portion 42 to the distal portion 43 strains the bond between the two sheets. As that strain increases with the increasing angle of incidence, the strain may become sufficient to decouple the two sheets, and allow the sheet feeder to move only the topmost sheet further along the sheet separator, eliminating a "multi-feed" situation. In an alternative, the surface of the first separator surface may curve from its proximal end to the distal end, rather than having separate planar surfaces.

As the sheet feeder continues to urge one or more sheets forward, so that the leading edge of the sheet continues to move along the first surface portion of the retard separator strip, the leading edge of the sheet or sheets passes the distal edge 45 of the first separator surface. Because the plane of the distal portion 43 of the first separator surface is above the plane of the second separator surface 44, the leading edge of the media sheet falls toward the second separator surface. The plane of the distal portion 43 of the first separator surface is more steeply angled with respect to the sheets of recording media in the stack than is the plane of the second separator surface 44. Thus, the plane of the distal portion 43 of the first separation surface and the plane of the second separation surface are oriented at an oblique angle relative to one another. If two or more sheets are still bonded so that they are both being urged along the retard separator strip, the higher friction second separator surface imposes a frictional force upon the lower or second of the sheets to aide in breaking the bond between the two sheets. Once the bond is broken between the sheets, the topmost sheet continues along the paper path, and the "multi-feed" situation is eliminated.

The retard separator strip includes a matched pair of engagement legs 46 to attach to the sheet separator frame. The engagement legs fit through openings in the sheet separator frame, as seen in FIG. 4. Referring to FIG. 5, the retard separator strip may be molded as a unitary apparatus with the engagement legs.

The length of the retard separator strip 40 is 24–26 mm, and may be approximately 24.5 mm (+/−0.2 mm), with the length A of the first separator surface approximately 16.0 mm (+/−0.1 mm), and the length B of the second separator surface approximately 8.5 mm (+/−0.1 mm). The edge 45 of the first separator surface 43 adjacent the second separator surface 44 is approximately 1.1–1.2 mm (C) above the plane of the second separator surface 44. The plane of the second separator surface may be oriented at an angle so that one end of the second separator surface at the end of the retard separator strip may be at a higher elevation than the end of the second separator surface that is adjacent the first separator surface. This elevation difference D may be 0.3 mm (+/−0.05 mm). The second separator surface 44 may be formed as a separate layer applied to the retard separator strip. This separate layer may have a thickness E of approximately 0.75–0.8 mm.

Ribs 48 projecting from the separator surface between the separator strips 38, 40 help to guide the leading edge of a sheet of recording media along the sheet separator.

The support surface on the stack elevator (FIG. 3) is configured to position the topmost sheet of the stack of recording media approximately 4 mm above of the bottom (proximal ends) of the separator strips 38, 40. The relative position of the topmost sheet of the stack and the separator strips remains substantially constant as the sheets are fed from the stack by having the stack elevator continually raise the bottom of the stack.

In a particular implementation, the sheet feeder 26 is approximately 1 mm from the separator strips in the horizontal direction (along the paper feed direction). However, in a particular implementation, the sheet feeder can move away from the separator strips in a manner to provide greater leverage to feed recording media of different weights against the sheet separator. In an exemplary implementation, the ends of the axle 30 of the sheet feeder are mounted in tracks 52. Resilient elements, such as springs 54, bias the sheet feeder toward the separator strips. In a particular implementation, the springs may be tension springs. The tracks may be angled downward very slightly, at, for example, 1.5° away from the separator strips.

If the sheets of recording media in the stack are relatively heavy and/or thick, as the sheet feeder urges the topmost sheet against the separator strips, and the leading edge of the sheet moves up the separator strip, the relatively heavier sheet does not bend as readily as lighter weight media to traverse the separator strips. The sheet feeder 26 then slides away from the separator strips along the tracks 52 to provide higher leverage to the engagement between the sheet of recording media and the separator strips 38, 40. The angle of the tracks on which the sheet feeder is mounted allows the sheet feeder to apply greater feeding force to a sheet for improved leverage if a sheet of heavy media requires greater effort to traverse the sheet separator. However, two or more sheets bonded by "edge welding" and fed together by the sheet feeder also causes the sheet feeder to respond as though it were feeding a single sheet of heavy recording media. The retard separator strips 40 operate as described above to decouple the topmost sheet from the other sheets that are moving with the topmost sheet.

The above description has been of a particular implementation of a sheet separator. After reading the above description and studying the accompanying drawings, those skilled in the art will recognize that various modifications can be made without detracting from the spirit of the invention. In particular, those skilled in the art will recognize numerous types of sheet feed mechanisms that can be used to urge a sheet of recording media from a stack toward the sheet separator apparatus. In addition, various modifications to the details of the separator strips and the retard separator strips can be made, as well as different arrangements of the separator strips and retard separator strips. Therefore, the invention is not limited to the particular implementation described above and shown in the accompanying drawings.

We claim:

1. An apparatus for separating a sheet of recording media from a stack of sheets, the apparatus comprising:

a support for supporting a stack of sheets of recording media; and a plurality of inclined separator strips;

wherein the inclined separator strips are substantially parallel one another;

wherein the surface of each inclined separator strip is oriented at an obtuse angle relative to the sheets of the stack of sheets;

wherein at least one of the inclined separator strips is a retard separator strip;

wherein the retard separator strip comprises a first separator surface and a second separator surface;

wherein the first separator surface is closer to the stack of sheets than is the second separator surface;

wherein the second separator surface has a higher coefficient of friction than the first separator surface; and wherein the plane of the at least a portion of the first separator surface of the at least one retard separator strip is above the plane of the second separator surface of the same retard separator strip.

2. An apparatus for separating a sheet of recording media from a stack of sheets, the apparatus comprising:

a support for supporting a stack of sheets of recording media; and a plurality of inclined separator strips;

wherein the inclined separator strips are substantially parallel one another;

wherein the surface of each inclined separator strip is oriented at an obtuse angle relative to the sheets of the stack of sheets;

wherein at least one of the inclined separator strips is a retard separator strip;

wherein the retard separator strip comprises a first separator surface and a second separator surface;

wherein the first separator surface is closer to the stack of sheets than is the second separator surface;

wherein the second separator surface has a higher coefficient of friction than the first separator surface;

wherein the first separator surface of the at least one retard separator strip includes a proximal portion and a distal portion; and wherein the proximal portion of the first separator surface is nearer the stack of sheets than is the distal portion of the first separator surface;

wherein the distal portion of the first separator surface is nearer the second separator surface of the same at least one retard separator strip than is the proximal portion of the first separator surface;

wherein the surface plane of the distal portion of the first separator surface forms a smaller oblique angle with respect to the sheets of the stack of sheets than does the surface plane of the proximal portion; and wherein the surface plane of the distal portion of the first separator surface is above the surface plane of the second separator surface.

3. An apparatus for separating a sheet of recording media from a stack of sheets, the apparatus comprising:

a support for supporting a stack of sheets of recording media; and a plurality of inclined separator strips;

wherein the inclined separator strips are substantially parallel one another;

wherein the surface of each inclined separator strip is oriented at an obtuse angle relative to the sheets of the stack of sheets;

wherein at least one of the inclined separator strips is a retard separator strip;

wherein the retard separator strip comprises a first separator surface and a second separator surface;

wherein the first separator surface is closer to the stack of sheets than is the second separator surface;

wherein the plane of the at least a portion of the first separator surface is above the plane of the second separator surface; and wherein the second separator surface has a higher coefficient of friction than the first separator surface.

4. An apparatus for separating a sheet of recording media from a stack of sheets, the apparatus comprising:

a support for supporting a stack of sheets of recording media; and a plurality of inclined separator strips;

wherein the inclined separator strips are substantially parallel one another;

wherein the surface of each inclined separator strip is oriented at an obtuse angle relative to the sheets of the stack of sheets;

wherein at least one of the inclined separator strips is a retard separator strip;

wherein the retard separator strip comprises a first separator surface and a second separator surface;

wherein the first separator surface is closer to the stack of sheets than is the second separator surface;

wherein the plane of the at least a portion of the first separator surface is above the plane of the second separator surface;

wherein the first separator surface of the at least one retard separator strip includes a proximal portion and a distal portion;

wherein the proximal portion of the first separator surface is nearer the stack of sheets than is the distal portion of the first separator surface;

wherein the distal portion of the first separator surface is nearer the second separator surface of the same at least one retard separator strip than is the proximal portion of the first separator surface; and wherein the surface plane of the distal portion of the first separator surface forms a smaller oblique angle with respect to the sheets of the stack of sheets than does the surface plane of the proximal portion;

wherein the at least one retard separator strip comprises two or more substantially identical retard separator strips;

wherein at least one non-retard separator strip is positioned between two of the substantially identical retard separator strips; and wherein the non-retard separator strip has a non-retard separator strip surface having a coefficient of friction substantially similar to the coefficient of friction of the first separator surface of the retard separator strips.

* * * * *